US010786843B2

(12) United States Patent
Nakamura et al.

(10) Patent No.: US 10,786,843 B2
(45) Date of Patent: Sep. 29, 2020

(54) METHOD OF MANUFACTURING MOLDED MATERIAL, AND SAID MOLDED MATERIAL

(71) Applicant: Nisshin Steel Co. Ltd., Tokyo (JP)

(72) Inventors: Naofumi Nakamura, Tokyo (JP); Yudai Yamamoto, Tokyo (JP)

(73) Assignee: Nisshin Steel Co., Ltd., Tokyo (JP)

( * ) Notice: Subject to any disclaimer, the term of this patent is extended or adjusted under 35 U.S.C. 154(b) by 0 days.

(21) Appl. No.: 16/337,567

(22) PCT Filed: Jun. 20, 2017

(86) PCT No.: PCT/JP2017/022727
§ 371 (c)(1),
(2) Date: Mar. 28, 2019

(87) PCT Pub. No.: WO2018/066181
PCT Pub. Date: Apr. 12, 2018

(65) Prior Publication Data

US 2019/0337038 A1 Nov. 7, 2019

(30) Foreign Application Priority Data

Oct. 3, 2016 (JP) ..... 2016-195605

(51) Int. Cl.
*B21D 24/00* (2006.01)
*B21D 24/06* (2006.01)

(52) U.S. Cl.
CPC ..... *B21D 24/005* (2013.01); *B21D 24/06* (2013.01)

(58) Field of Classification Search
CPC ..... B21D 22/24; B21D 24/005; B21D 24/06
(Continued)

(56) References Cited

U.S. PATENT DOCUMENTS 3,945,231 A * 3/1976 Imazu ..... B21D 22/20 72/45
5,105,645 A * 4/1992 Kobayashi ..... B21D 51/26 72/348
(Continued)

FOREIGN PATENT DOCUMENTS

EP 2842650 3/2015
JP S59-51374 12/1984
(Continued)

OTHER PUBLICATIONS

International Search Report and Written Opinion, counterpart International Appl. No. PCT/JP2017/022727, with English translation of the International Search Report and English unofficial translation of the Written Opinion (dated Aug. 29, 2017) (13 pages).
(Continued)

*Primary Examiner* — Adam J Eiseman
*Assistant Examiner* — Stephen Floyd London
(74) *Attorney, Agent, or Firm* — Cook Alex Ltd.

(57) ABSTRACT

A method for manufacturing a molded member includes carrying out a multi-stage drawing process and at least one finishing ironing process on a base metal sheet, the molded member including a tubular body and a flange formed at an end portion of the body. The multi-stage drawing process includes a preliminary drawing process for forming a preliminary body having a body element from the base metal sheet, and a plurality of compression drawing processes performed after the preliminary drawing process, the compression drawing processes drawing the body element while applying compressive force along a depth direction of the body element to a circumferential wall of the body element. The at least one finishing ironing process is carried out such that a mold clearance of an upper portion of the body
(Continued)

element is narrower than a mold clearance of a lower portion of the body element.

4 Claims, 17 Drawing Sheets

(58) Field of Classification Search
USPC ..... 72/349
See application file for complete search history.

(56) References Cited

U.S. PATENT DOCUMENTS

| | | | | |
|---|---|---|---|---|
| 5,179,854 | A * | 1/1993 | Matsui | B21D 22/28 72/349 |
| 5,329,799 | A * | 7/1994 | Ito | B21D 22/30 72/340 |
| 5,686,194 | A * | 11/1997 | Shimizu | B32B 15/08 428/626 |
| 5,778,722 | A * | 7/1998 | Saiki | B21D 51/26 72/347 |
| 6,568,064 | B2 * | 5/2003 | Kanno | H02K 1/17 29/596 |
| 2004/0244458 | A1 * | 12/2004 | Yamano | B21D 5/01 72/350 |
| 2005/0115050 | A1 * | 6/2005 | Ezaka | B21D 22/28 29/523 |
| 2006/0266092 | A1 * | 11/2006 | Kawai | B21D 22/28 72/349 |
| 2008/0314112 | A1 | 12/2008 | Park et al. | |
| 2015/0093591 | A1 * | 4/2015 | Walde | B21D 22/21 428/603 |
| 2016/0114371 | A1 * | 4/2016 | Lord | B21D 22/24 72/336 |
| 2016/0144418 | A1 | 5/2016 | Nakamura et al. | |

FOREIGN PATENT DOCUMENTS

| | | |
|---|---|---|
| JP | H11-091773 | 4/1999 |
| JP | 2000-005827 | 1/2000 |
| JP | 2002-178047 | 6/2002 |
| JP | 2009-050912 | 3/2009 |
| JP | 2009-522114 | 6/2009 |
| JP | 2013-051765 | 3/2013 |
| JP | 2013-146751 | 8/2013 |
| JP | 5697787 | 4/2015 |
| TW | 200920513 | 5/2009 |
| WO | WO2008136643 | 11/2008 |

OTHER PUBLICATIONS

Murakawa et al., Basics of Plastic Processing, First Edition, Sangyo-Tosho Publishing Co. Ltd., pp. 104-107, with English translation (Jan. 16, 1990) (13 pages).

English translation of the International Preliminary Report on Patentability, counterpart International App. No. PCT/JP2017/022727 (dated Apr. 18, 2019) (7 pages).

Japanese Office Action for corresponding Japanese application No. 2016-195605, with English-language translation, dated Jul. 29, 2020 (8 pages).

Taiwanese Office Action for corresponding Taiwanese application No. 106122884, with English-language translation, dated Jul. 31, 2020 (8 pages).

* cited by examiner

[FIG. 1]
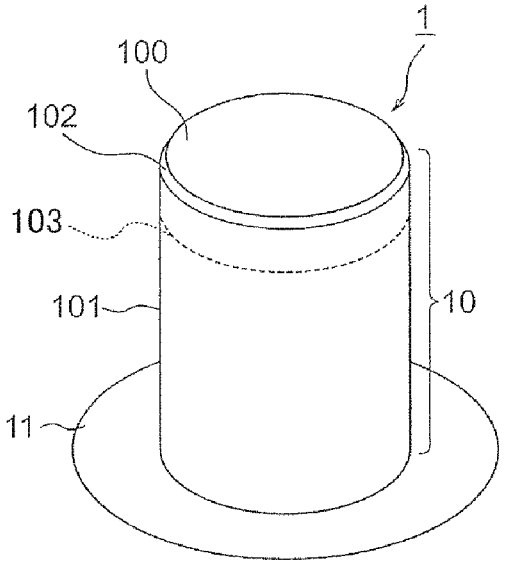

[FIG. 2]
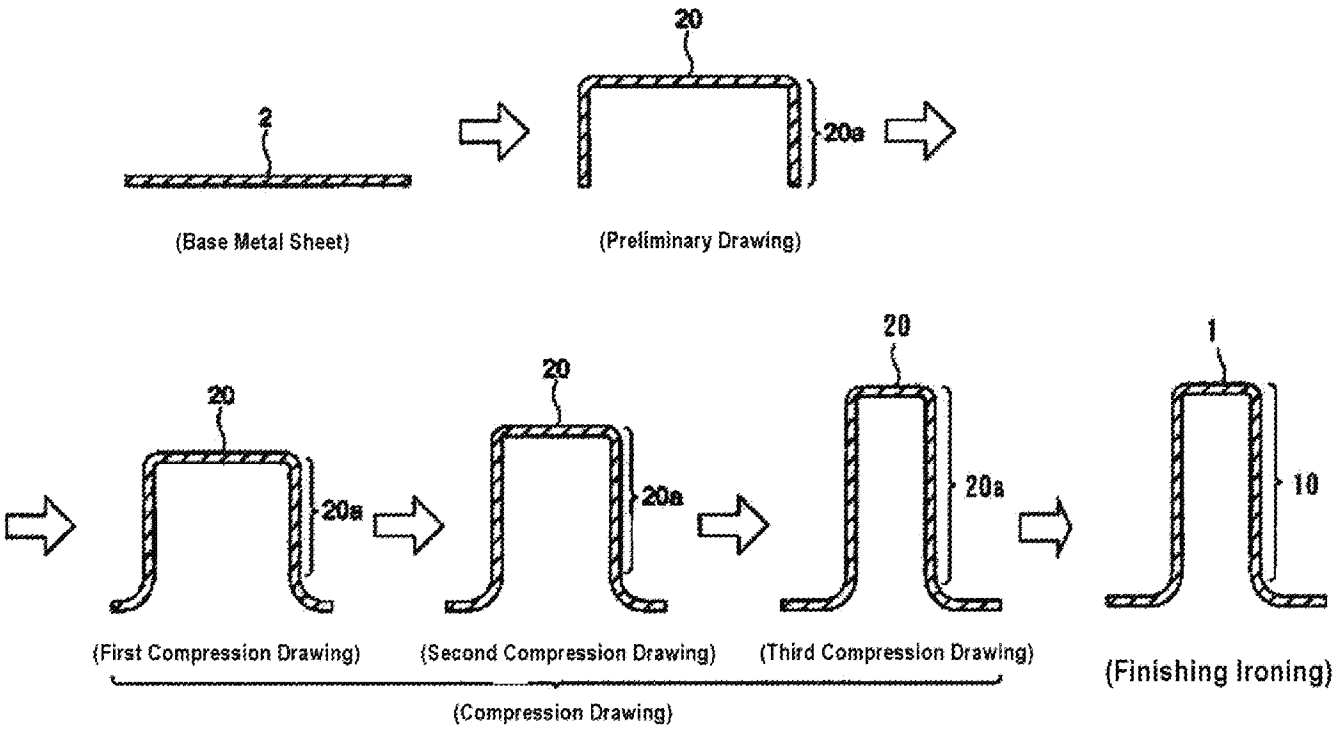

[FIG. 3]
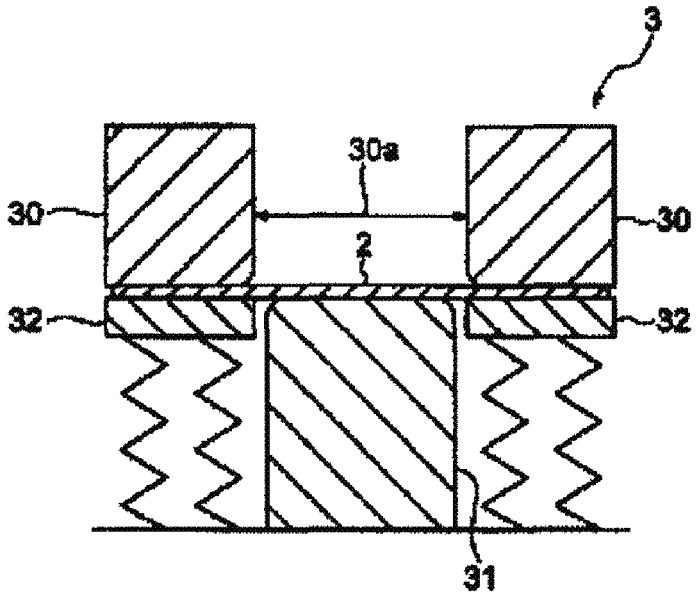

[FIG. 4]
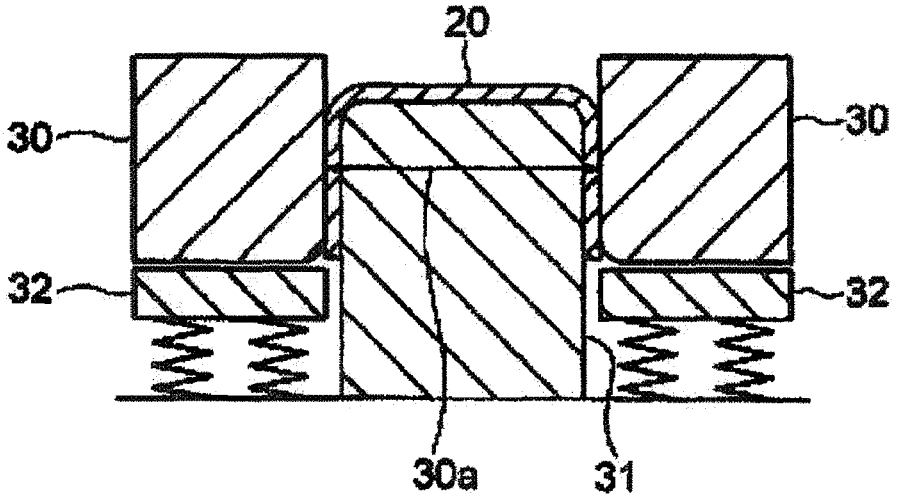

[FIG. 5]
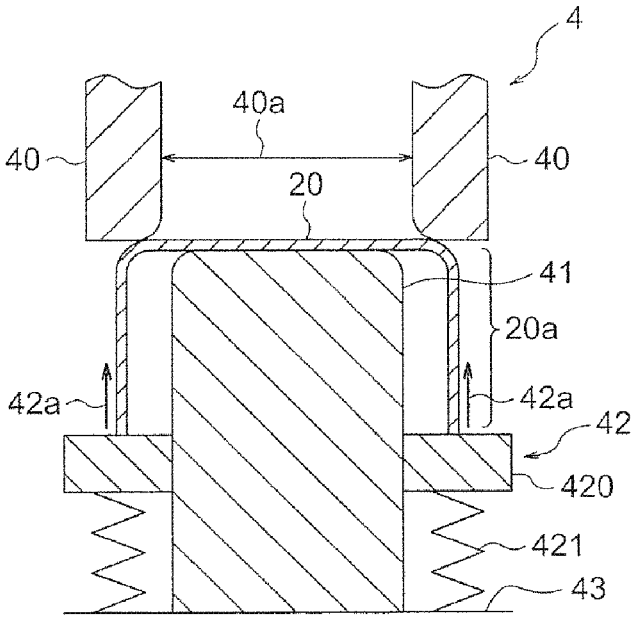

[FIG. 6]
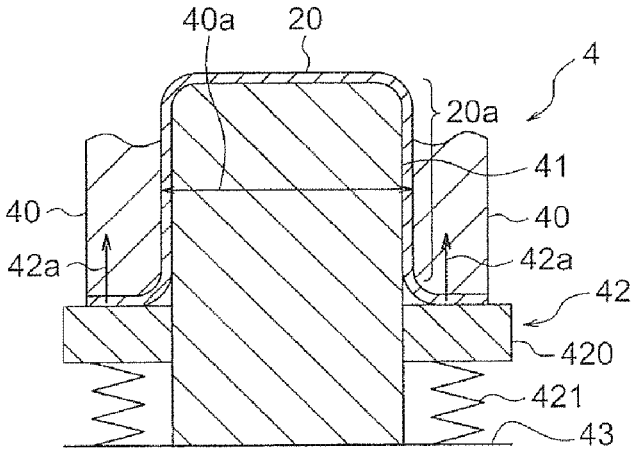

[FIG. 7]
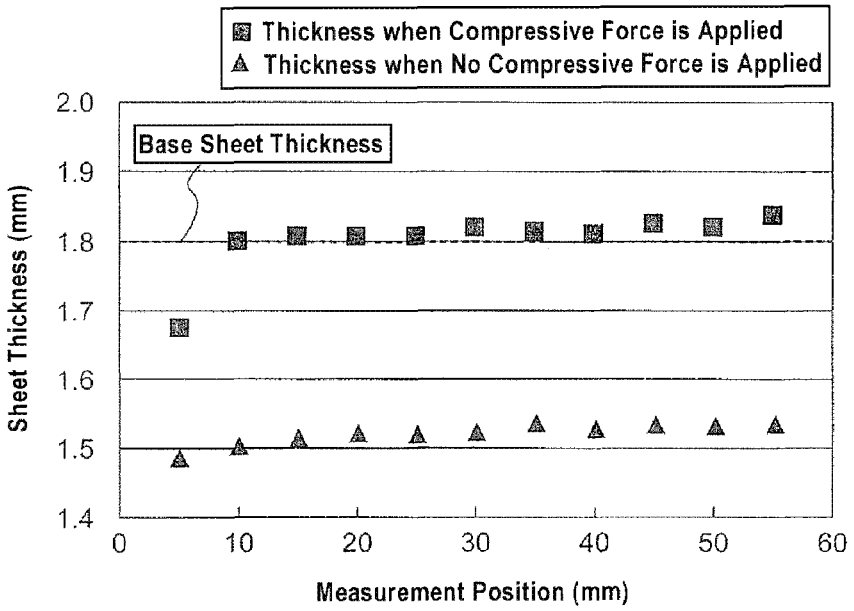

[FIG. 8]
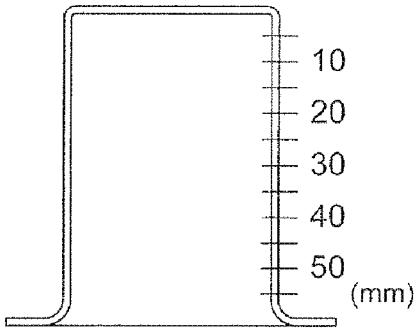

[FIG. 9]
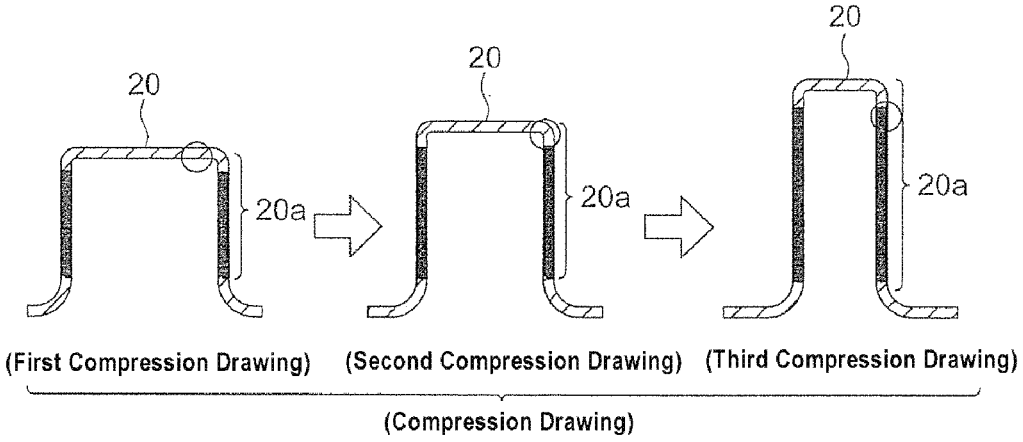

[FIG. 10]
(a)
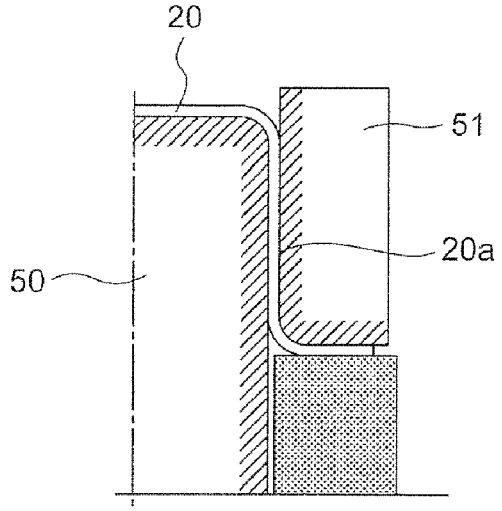
(b)
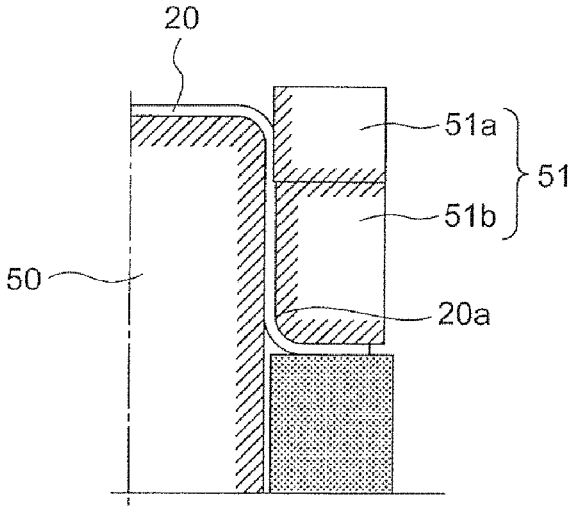

[FIG. 11]
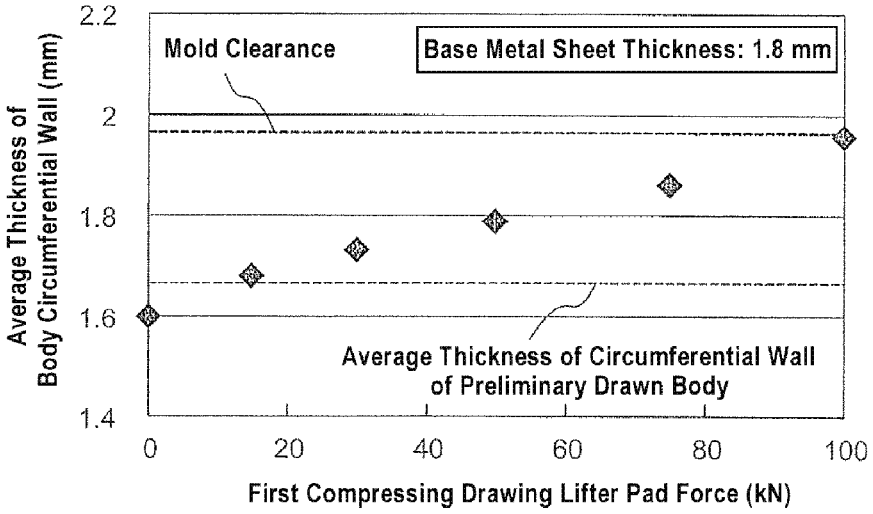

[FIG. 12]
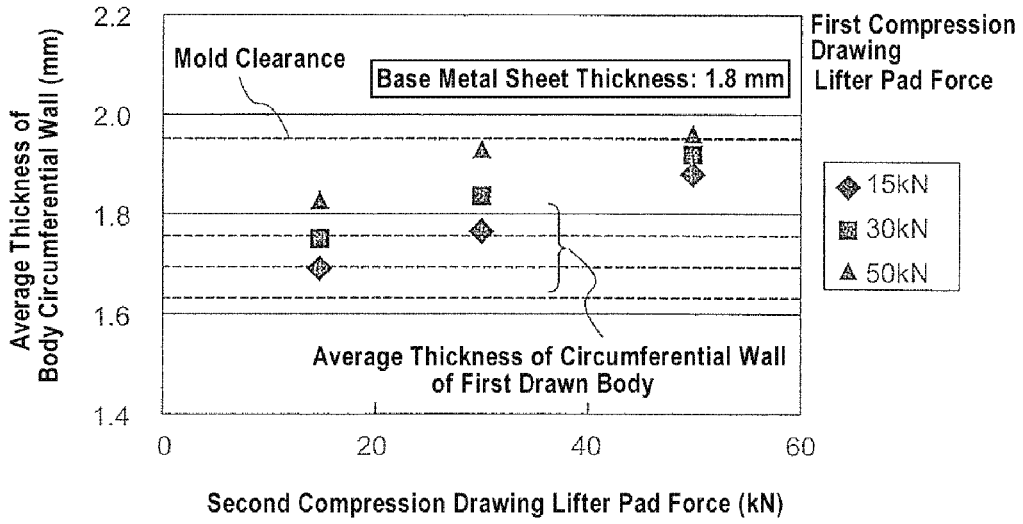

[FIG. 13]
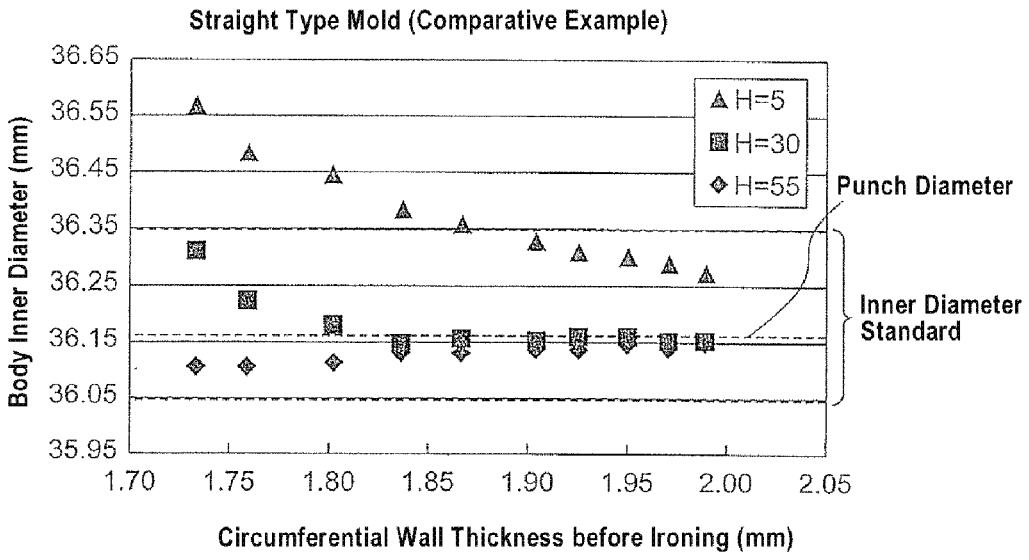

[FIG. 14]
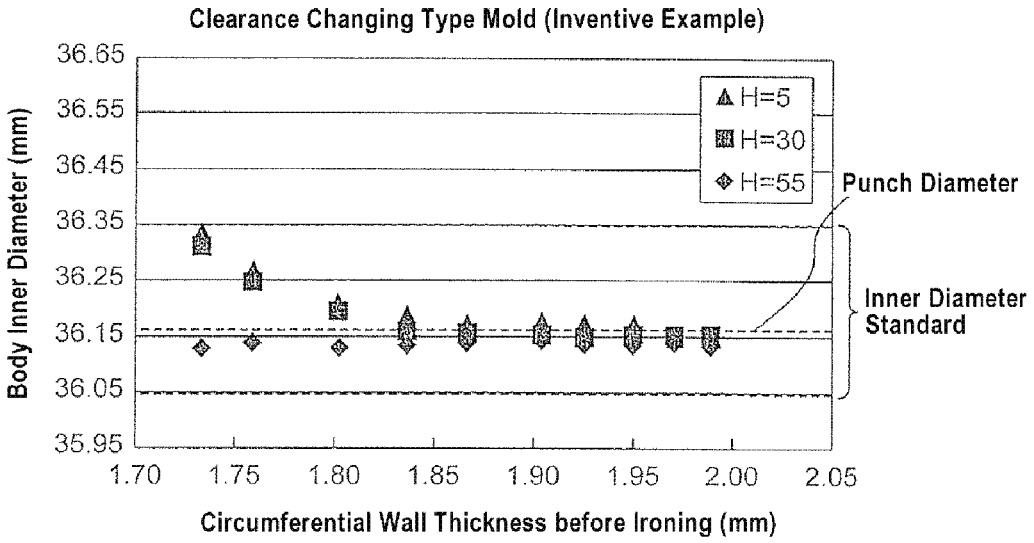

[FIG. 15]
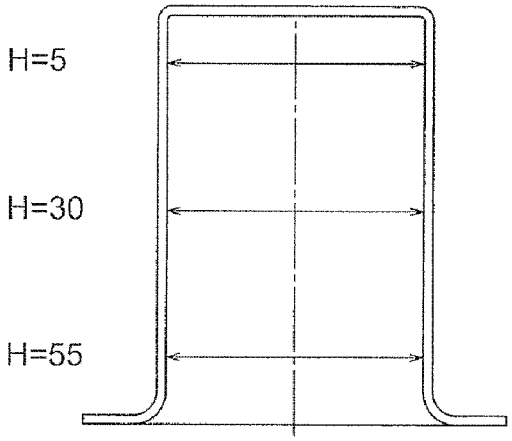

[FIG. 16]
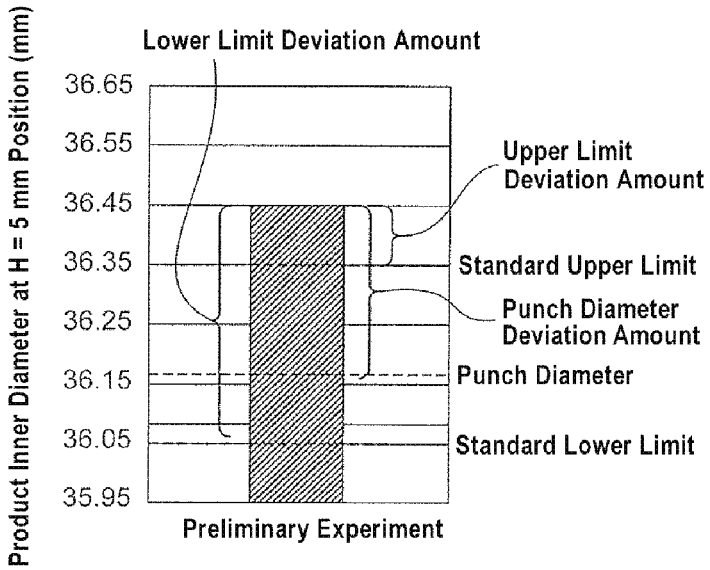

[FIG. 17]
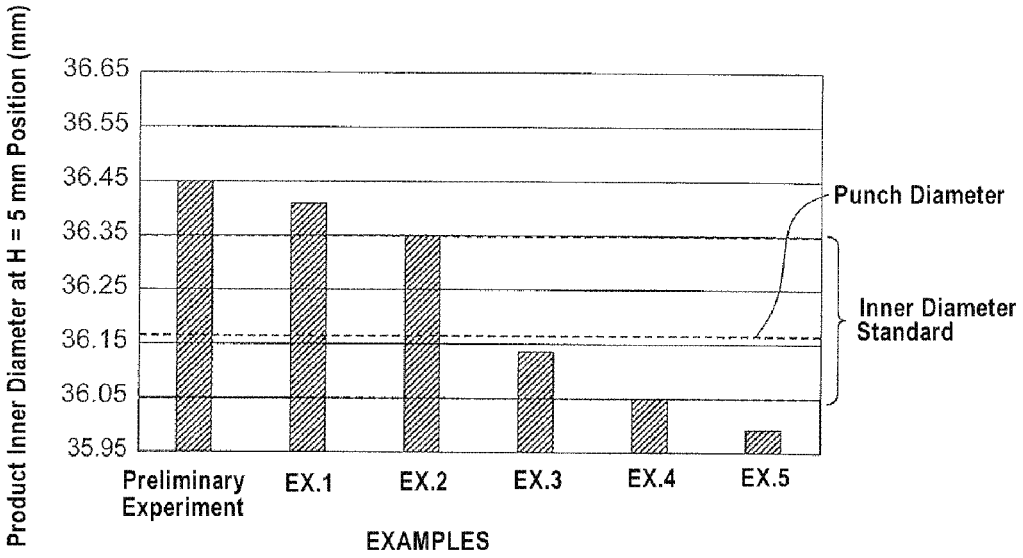

METHOD OF MANUFACTURING MOLDED MATERIAL, AND SAID MOLDED MATERIAL

The present application is a U.S. National Stage of PCT International Patent Application No. PCT/JP2017/022727, filed Jun. 20, 2017, which claims priority to JP Application No. 2016-195605, filed Oct. 3, 2016, both of which are hereby incorporated herein by reference.

TECHNICAL FIELD

This invention relates to a method for manufacturing a molded member including a tubular body and a flange formed at an end portion of the body.

BACKGROUND ART

As disclosed, for example, in non-patent document 1 as described below, a molded member including a tubular body and a flange formed at an end portion of the body is manufactured by performing a drawing process. The drawing process forms the body by stretching a base metal sheet, so that a thickness of a circumferential wall of the body is generally lower than that of the base material sheet.

The molded member molded by the drawing process as described above may be used as a motor case disclosed, for example, in patent document 1 and the like as described below. In this case, the circumferential wall of the body is expected to function as a shielding material for preventing magnetic leakage to the outside of the motor case. Depending on motor structures, the circumferential wall is also expected to function as a back yoke of a stator.

The performance of the body as the shield material or back yoke is improved as the thickness of the body increases. Therefore, when a molded member is produced by the drawing process as described above, a base metal sheet with a thickness larger than the required thickness of the circumferential wall of the body is selected taking into account the reduction in thickness of the body. However, the thickness of the base metal sheet is not always constant, and varies within an allowable range of the thickness called tolerance of thickness. Further, due to change of a state of a mold or variations in material properties, an amount of thickness reduction in the drawing process may also vary.

On the other hand, in order to reduce the vibration and noise of the motor, highly accuracy of an inner diameter may be required for the inner diameter of the motor case. Therefore, typically, after a drawing process, a finishing ironing process is performed on the body to improve the accuracy of the inner diameter. The finishing ironing process is carried out by sandwiching the material of the body from both the inner side and the outer side and applying the ironing using two molds (a punch and a die) in which a gap (clearance) between the two molds is set to be less than the thickness of the material of the body. The setting of the clearance to be less than the thickness of the material of the body refers to minus clearance.

In the ironing process, when the thickness of the base sheet of the body before the ironing process is thinner than a required thickness, an amount of ironing will become insufficient for an ironing mold prepared beforehand, leading to decreased accuracy of the inner diameter. Conversely, when the thickness of the base sheet is thicker than the required thickness, the accuracy of the inner diameter after the finishing ironing process is satisfied, but another problem is caused that plating residues are generated and fall off from the surface of the molded product when the base metal sheet is a surface-treated steel sheet on which its surface is plated. These problems are caused by the following reasons: the thickness of the circumferential wall of the body before the finishing ironing process varies due to variations in the thickness of the base metal sheet or variations in the thickness reduction rate during the drawing process, but the clearance of the mold for carrying out the finishing ironing process is fixed, so that the variation in the thickness of the circumferential wall of the body before the finishing ironing process cannot be absorbed by the finishing ironing process.

Thus, Patent Document 2 as described below proposes a compression drawing method of controlling an increase/decrease in a thickness of a circumferential wall of a body element by applying an adjustable compressive force to the circumferential wall of the body element when subjecting the body element to the drawing process.

CITATION LIST

Non-Patent Literature

Non-patent Document 1: Masao Murakawa, et. al., "Basics of Plastic Processing", First Edition, SANGYO-TOSHO Publishing Co. Ltd., Jan. 16, 1990, pp. 104 to 107

Patent Literatures

Patent Document 1: Japanese Patent Application Publication No. 2013-51765 A
Patent Document 2: Japanese Patent No. 5697787 B

SUMMARY OF INVENTION

Technical Problem

Even if the compression drawing method of Patent Document 2 is used to produce a molded member, it is difficult to form a molded member having a higher ratio of height to diameter (height/diameter) by one drawing process, and it is necessary to form the molded member by a plurality of drawing processes. The plurality of drawing processes gradually increases the height of the body element. That is, a material of an upper portion of the body of the final molded member is positioned near a top wall of the body element at least in the initial drawing process, and is not subjected to any sufficient compressive force. Therefore, any sufficient thickening effect cannot be obtained at the upper portion of the body of the final molded member, and an insufficient amount of ironing at that upper portion may lead to deteriorated inner diameter accuracy.

The present invention has been made to solve the above problems. An object of the present invention is to provide a method for manufacturing a molded member, which can provide improved inner diameter accuracy over the entire body of the molded member.

Solution to Problem

The present invention relates to a method for manufacturing a molded member by carrying out a multi-stage drawing process and a finishing ironing process on a base metal sheet, the molded member comprising: a tubular body; and a flange formed at an end portion of the body, wherein the multi-stage drawing process comprises; a preliminary drawing process for forming a preliminary body having a body element from the base metal sheet; and a plurality of compression drawing processes performed after the preliminary drawing process, the compression drawing processes drawing the body element while applying compressive force along a depth direction of the body element to a circumferential wall of the body element; and wherein the at least one finishing ironing process is carried out such that a mold clearance of an upper portion of the body element is narrower than a mold clearance of a lower portion of the body element.

Advantageous Effects of Invention

According to the method for manufacturing the molded member and the molded member of the present invention, the at least one finishing ironing process is carried out such that the mold clearance of the upper portion of the body element is narrower than the mold clearance of the lower portion of the body element, so that even if the upper portion of the body element is not sufficiently thickened by the compression drawing, an insufficient amount of ironing can be avoided in the upper portion of the body element. This can allow improved inner diameter accuracy to be obtained over the entire body of the molded member.

BRIEF DESCRIPTION OF DRAWINGS

FIG. 1 is a perspective view showing a molded member manufactured by a method for manufacturing a molded member according to Embodiment 1 of the present invention.

FIG. 2 is an explanatory view illustrating a method for manufacturing the molded member shown in FIG. 1.

FIG. 3 is an explanatory view showing a mold used for preliminary drawing in FIG. 2.

FIG. 4 is an explanatory view illustrating preliminary drawing with the mold shown in FIG. 3

FIG. 5 is an explanatory view illustrating a mold used in the first compression drawing shown in FIG. 2.

FIG. 6 is an explanatory view showing a first compression drawing process performed with the mold shown in FIG. 5.

FIG. 7 is a graph showing a sheet thickness distribution of a body element in a preliminary body after the end of third compression drawing.

FIG. 8 is an explanatory view showing a sheet thickness measuring positions in FIG. 7.

FIG. 9 is an explanatory view showing movement of a material in a first to third compression drawing processes in FIG. 2.

FIG. 10(*a*) illustrates a general finishing ironing mold for comparison, and FIG. 10(*b*) illustrated a finishing ironing mold used in the method for manufacturing the molded member according to the present embodiment.

FIG. 11 is a graph showing a relationship between a lifter pad force and an average thickness of a circumferential wall of a body in a first compression drawing process.

FIG. 12 is a graph showing a relationship between a lifter pad force and an average thickness of a circumferential wall of a body in a second compression drawing process.

FIG. 13 is a graph showing a relationship between a sheet thickness of a circumferential wall before finish ironing and a product inner diameter at each measurement position in a molded member performed using a straight type mold shown in FIG. 10 (*a*).

FIG. 14 is a graph showing a relationship between a sheet thickness of a circumferential wall before finish ironing and a product inner diameter at each measurement position in a molded member performed using a clearance changing type mold shown in FIG. 10 (*b*).

FIG. 15 is an explanatory view showing inner diameter dimension measurement positions in FIGS. 13 and 14.

FIG. 16 is an explanatory view showing an example of a relationship between a measured inner diameter of a molded member 1 produced by a preliminary experiment and a standard dimension or the like.

FIG. 17 is a graph showing a change of an upper inner diameter of a molded member 1 when changing a mold clearance of an upper portion of a body element by a clearance changing type mold.

DESCRIPTION OF EMBODIMENTS

Embodiments of the present invention will be described below with reference to the drawings.

Embodiment 1

FIG. 1 is a perspective view showing a molded member 1 manufactured by a method for manufacturing a mold member according to Embodiment 1 of the present invention. As shown in FIG. 1, the molded member 1 manufactured by the method for manufacturing the molded member according to the present embodiment includes a body 10 and a flange 11. The body 10 is a tubular portion having: a top wall 100; a circumferential wall 101 that extends from an outer edge of the top wall 100; and a shoulder 102 composed of a curved surface which connects the top wall 100 to the circumferential wall 101. Depending on the orientation of the molded member 1 to be used, the top wall 100 may be referred to by other terms, such as a bottom wall. In FIG. 1, the body 10 is shown to have a perfectly circular sectional shape, but the body 10 may have another shape, for example, such as an elliptical sectional shape or angular tubular shape. The top wall 100 may be subjected to further processing. For example, a protrusion further projecting from the top wall 100 can be formed. The flange 11 is a sheet portion formed on an end portion (an end portion of the circumferential wall 101) of the body 10.

The molded member 1 of the embodiment 1 is provided with a linear pattern 103 at a boundary position between the circumferential wall 101 of the body 10 and the shoulder 102. The linear pattern 103 is caused by finishing ironing which will be described below.

Next, FIG. 2 is an explanatory view illustrating the method for manufacturing the molded member 1 shown in FIG. 1. The method for manufacturing the molded member according to the present invention produces the molded member 1 by subjecting a flat base metal sheet 2 to multi-stage drawing and finishing ironing. The multi-stage drawing includes preliminary drawing and at least one compression drawing performed after the preliminary drawing. In the method for manufacturing the molded member according to this embodiment, three compression drawing processes (first to third compression drawing processes) are carried out. The base metal sheet 2 that can be used includes a metal sheet whose surface is subjected to various plating.

The preliminary drawing is a step of forming a preliminary body 20 including a body element 20*a* by processing the base metal sheet 2. The body element 20*a* is a tubular body having a larger diameter and a shallower depth than the body 10 shown in FIG. 1. The depth direction of the body element 20*a* is defined by an extending direction of the circumferential wall of the body element 20*a*. In the present embodiment, the entire preliminary body 20 constitutes the body element 20*a*. However, a preliminary body 20 including a flange may be formed. In this case, the flange does not constitute the body element 20*a*.

As will be described below in detail, the first to third compression processes are steps of drawing the body element 20*a* while applying a compressive force 42*a* (see FIG. 5) along the depth direction of the body element 20*a* to the body element 20*a*. The phrase "drawing the body element 20*a*" means reducing a diameter of the body element 20*a* and also increasing a depth of the body element 20*a*.

As described in detail below, the finishing ironing carries out ironing (thinning) of the circumferential wall of the body element 20*a* of the preliminary body 20 which has undergone the multistage drawing process, by sandwiching the circumferential wall from both sides of the inner side and the outer side with a pinch and a die, so that the inner diameter and the outer diameter of the body element 20*a* allow to coincide with the outer diameter of the punch and the inner diameter of the die. Through the finishing ironing process, the molded member 1 is formed from the preliminary body 20.

Next, FIG. 3 is an explanatory view illustrating a mold 3 used in the preliminary drawing shown in FIG. 2, and FIG. 4 is an explanatory view illustrating the preliminary drawing performed with the mold 3 shown in FIG. 3. As shown in FIG. 3, the mold 3 used in the preliminary drawing includes a die 30; a punch 31; and a cushion pad 32. The die 30 is provided with a pushing hole 30*a* into which the base metal sheet 2 is pushed together with the punch 31. The cushion pad 32 is disposed at an outer circumferential position of the punch 31 so as to face an outer end surface of the die 30. As shown in FIG. 4, in the preliminary drawing, an outer edge portion of the base metal sheet 2 is not completely constrained by the die 30 and the cushion pad 32, and the outer edge portion of the base metal sheet 2 is drawn out until it escapes from the constraint applied thereto by the die 30 and the cushion pad 32. The entire base metal sheet 2 may be pushed together with the punch 31 into the pushing hole 30*a* and drawn out. When forming the preliminary body 20 including the flange as described above, the outer edge portion of the base metal sheet 2 may be stopped at such a depth that it does not escape from the restraint applied thereto by the die 30 and the cushion pad 32.

Next, FIG. 5 is an explanatory view illustrating a mold 4 used in the first compression drawing in FIG. 2, and FIG. 6 is an explanatory view showing the first compression drawing by means of the mold 4 in FIG. 5. As shown in FIG. 5, the mold 4 used in the first compression drawing includes a die 40; a punch 41; a lifter pad 42; and a punch holder 43. The die 40 is a member having a pushing hole 40*a*. The punch 41 is a cylindrical body which is inserted into the inside of the body element 20*a* to push the body element 20*a* into the pushing hole 40*a* and which is supported by the punch holder 43.

The lifter pad 42 is disposed at an outer circumferential position of the punch 41 so as to face the die 40. More particularly, the lifter pad 42 includes a pad portion 420 and an urging portion 421. The pad portion 420 is an annular member disposed at the outer circumferential position of the punch 41 so as to face the die 40. The urging portion 421 is disposed on a lower portion of the pad portion 420, and urges and supports the pad portion 420. Further, the urging portion 421 is supported by the punch holder 43. On the pad portion 420, a lower end of the circumferential wall of the body element 20*a* is placed. The circumferential wall of the body element 20*a* is sandwiched between the die 40 and the pad portion 420 when the die 40 descends. By thus sandwiching the circumferential wall of the body element 20*a* between the die 40 and the pad portion 420, an urging force (a lifter pad force) of the urging portion 421 is applied to the body element 20*a* as the compressive force 42*a* along the depth direction of the body element 20*a*. That is, the lifter pad 42 constitutes a pressurizing means for applying to the body element 20*a* the compressive force 42*a* along the depth direction of the body element 20*a*.

As shown in FIG. 6, in the first compression process, the die 40 descends, whereby the body element 20*a* is pushed into the pushing hole 40*a* together with the punch 41, so that the body element body 20*a* is drawn. In this case, after the circumferential wall of the body element 20*a* is sandwiched between the die 40 and the pad portion 420, the compressive force 42*a* along the depth direction of the body element 20*a* continues to be applied to the body element 20*a*. That is, in the first compressing process, the body element 20*a* is drawn while applying the compressive force 42*a*. As will be described below in detail, when the compressive force 42*a* satisfies a predetermined condition, the body element 20*a* can be drawn without causing a decrease in the thickness of the body element body 20*a*. As a result, the thickness of the body element 20*a* which has undergone the first compression process is equal to or higher than the thickness of the body element 20*a* prior to the first compression drawing.

During the processing, the lower surface of the lifter pad 42 is in a state where it can move up and down without coming into contact with the upper surface of the punch holder 43. This is not in so-called bottom-hitting state, and it is in state where the die 40 which has moved down and the lifter pad 42 which is moving up due to the urging force (lifter pad force) of the urging portion 421 are balanced via the body element 20*a* during the processing.

It should be noted that the structure in which the lifter pad 42 is bottom-fitted means a configuration in which the urging force (lifter pad force) of the urging portion 421 is smaller than deformation resistance force when the body element 20*a* is deformed to reduce the diameter. In the configuration, the molding force is balanced between the die 40 which has moved down and the punch holder 43, so that the subject of the urging force (lifter pad force) applied to the body element 20*a* will be only the deformation resistance when the diameter of the body 20*a* is reduced to be press-fitted into the die 40. Therefore, factors contributing to the increase in thickness are a mold clearance between the die 40 and the punch, which mainly relates to the deformation resistance, a die R, and a material strength (yield strength× cross sectional area) of the body element 20*a*. Once these conditions are determined, they can be easily changed. In other words, it can be difficult to control the increase and decrease of the sheet thickness responding to the sheet thickness variation of the base metal sheet in the compression mold having the bottom hitting structure.

The second compression drawing process and the third compression drawing process in FIG. 2 are performed using a mold having the same arrangement as that of the mold 4 shown in FIGS. 5 and 6. However, the dimensions of the die 40 and the punch 41 may be changed as needed. In the second compression drawing process, the body element 20*a* after the first compression drawing process is drawn while applying the compressing force 42*a*. Further, in the third compression drawing process, the body element 20*a* after the second compression drawing process is drawn while applying the compressing force 42*a*. After these first to third compression drawing processes are carried out, the finishing ironing process is carried out, whereby the body 10 is formed from the body element 20*a*.

The compression force in the first to third compression drawing processes is adjusted such that the sheet thickness (the sheet thickness immediately before the finishing ironing) of the body element 20*a* after the end of the third compression drawing process is a predetermined thickness. As a result, in the finishing ironing, the processing is performed with appropriate mold clearance that satisfies the inner diameter accuracy and does not generate plating residues.

Next, FIG. 7 is a graph showing a sheet thickness distribution of the body element 20*a* in the preliminary body at the end of the third compression drawing process, and FIG. 8 is an explanatory view showing sheet thickness measurement positions in FIG. 7. Using a circular plate having a thickness of 1.8 mm, a plated amount of 90 g/m$^2$ and a diameter of 116 mm, in which Zn—Al—Mg plating was applied onto a cold-rolled steel sheet of common steel as the base metal sheet 2, the preliminary drawing and the first to third compression drawing were performed. The processing conditions are the same as those in Examples described below. As shown by "■" (solid square) in FIG. 7, the sheet thickness of the circumferential wall of the body element 20*a* after the end of the third compression drawing is larger than the sheet thickness of the base plate except for the upper portion (near the shoulder; measurement position: 5 mm position). On the other hand, the upper portion (near the shoulder; measurement position: 5 mm position) is thinner than the sheet thicknesses of the other portions.

Next, FIG. 9 is an explanatory view showing the movement of the material in the first to third compression drawing processes in FIG. 2. In FIG. 9, a material positioned at an upper portion of the body element 20*a* in the preliminary body after the end of the third compression drawing, more specifically, a material positioned near the shoulder, is indicated by a circle. Further, regions where the thickening effect is exerted by the action of the compressive force 42*a* (see FIG. 6) are indicated as black portions. As shown in FIG. 9, the material positioned at the upper portion of the body element 20*a* after the end of the third compression drawing is located at the top wall 100 or near the top wall 100 in the first and second compression drawing processes. Therefore, it is believed that at the upper portion of the body element 20*a*, any sufficient thickening effect could not be obtained by the first and second compression drawing processes, thereby resulting in the sheet thickness distribution in which the thickness of the upper portion of the body element 20*a* became locally thinner, as shown in FIG. 7.

As shown by "▲" (solid triangle) in FIG. 7, when the drawing process is performed without applying the compressive force 42*a*, the sheet thickness of the body element 20*a* is thinner than the sheet thickness of the base sheet, but the sheet thickness distribution of the body element 20*a* is substantially uniform. It is believed that the local thinned thickness of the upper portion of the body element 20*a* is a specific phenomenon when a plurality of compression drawing processes is performed.

Next, FIG. 10 is an explanatory view showing a finishing ironing mold used in the finishing ironing process in FIG. 2, FIG. 10 (*a*) shows a general finishing ironing mold for comparison, and FIG. 10 (*b*) shows a finishing ironing mold used in the method for manufacturing the molded member according to the present embodiment.

As shown in FIGS. 10 (*a*) and 10 (*b*), the finishing ironing die is provided with a punch 50 and a die 51. The preliminary body 20 is inserted together with the punch 50 into a pushing hole of the die 51 while covering the punch 50 with the preliminary body 20.

As shown in FIG. 10 (*a*), in the general finishing ironing die, an inner wall of the die 51 extends in parallel to the depth direction of the body element 20*a*, and the clearance between the punch 50 and the die 51 is constant over the entire region in the depth direction of the body element 20*a*. When the ironing process of the preliminary body 20 having a locally thinner sheet thickness in the upper portion of the body element 20*a* is performed using such a general finishing ironing die, an ironing amount on the upper portion of the body element 20*a* may become insufficient. Hereinafter, the mold as shown in FIG. 10 (*a*) is referred to as a straight type mold.

As shown in FIG. 10 (*b*), in the finishing ironing die used in the method for manufacturing the molded member according the present embodiment, the die 51 is composed of a first divided die 51*a* and a second divided die 51*b*. The first divided die 51*a* is disposed on an upper portion of the second divided die 51*b* so as to perform the ironing process on the upper portion of the body element 20*a*. The second divided die 51*b* is disposed on a lower portion of the first divided die 51*a* so as to perform the ironing process on the lower portion of the body element 20*a*. In other words, in the mold of FIG. 10 (*b*), the die 51 is divided into two parts in the depth direction of the body element 20*a* such that the vicinity of the shoulder of the preliminary body 20 forms a boundary between them. An inner diameter of the pushing hole of the first divided die 51*a* for performing the ironing process on the upper portion is narrower than an inner diameter of the pushing hole of the second divided die 51*b* for performing the ironing process on the lower portion. That is, in the mold used in the method for manufacturing the molded member according to the present embodiment, the mold clearance of the upper portion of the body element 20*a* is narrower than the mold clearance of the lower portion of the body element 20*a*. The use of such a mold can allow a sufficient amount of ironing to be ensured on the upper portion of the body element 20*a*, even if the thickness of the upper portion of the body element 20*a* is locally thinner. Hereinafter, the mold as shown in FIG. 10 (*b*) is referred to as a clearance changing type mold.

It should be noted that the linear pattern 103 shown in FIG. 1 is formed by pressing the lower end of the first divided die 51*a* against the outer peripheral surface of the body element 20*a*, and it can be a feature of the molded member 1 manufactured using the clearance changing type mold.

EXAMPLES

Examples will be now illustrated. The present inventors investigated a relationship between magnitude of supporting force of the lifter pad (lifter pad force) during compression and an average sheet thickness (mm) of the circumferential wall of the body of the body element 20*a*, using, as the base metal sheet 2, circular sheets each having a thickness of 1.8 mm, a plated amount of 90 g/m2 and a diameter of 116 mm, in which Zn—Al—Mg plating was applied onto a common cold-rolled steel sheet (FIGS. 11 and 12).

Further, the present inventors investigated a relationship a sheet thickness of the circumferential wall before finishing ironing and an inner diameter dimension of the molded member after the finishing ironing, using the body elements 20*a* before finishing ironing, having various thicknesses of the circumferential walls produced by changing the lifter pad force in the compression step (FIG. 13 and FIG. 14). For the finishing ironing, two kinds of molds: straight type and clearance changing type molds were used.

First, the processing conditions are as follows.

Curvature radius of die shoulder: from 0.45 to 10 mm;

Diameter of Punch:

Preliminary drawing 66 mm,
First compression drawing 54 mm,
Second compression drawing 43 mm,
Third compression drawing 36.16 mm,
Finish ironing 36.16 mm;

Mold clearance between die and punch (one side):

Preliminary drawing 2.00 mm,
First compression drawing 1.95 mm,
Second compression drawing 1.95 mm,
Third compression Drawing 1.95 mm,
Finish ironing 1.85 mm;

Supporting force of lifter pad: from 0 to 100 kN; and

Press oil: TN-20N.

FIG. 11 is a graph showing the relationship between the lifter pad force and the average thickness of the circumferential wall of the body in the first compression drawing. In FIG. 11, the vertical axis represents an average thickness of the circumferential wall of the body after the first compression drawing, and the horizontal axis represents a first compression drawing lifter pad force (kN). It should be noted that the average thickness of the circumferential wall of the body is obtained by averaging the thickness of the circumferential wall from a R stop on the flange side of the punch shoulder radius to a R stop on the top wall side of the punch shoulder radius. It can be seen that the average thickness of the circumferential wall of the body increases almost linearly as the lifter pad force during the first compression drawing increases. It can be also seen that a lifter pad force of about 15 kN or more during the first compression drawing can increase the thickness as compared with the average thickness of the circumferential wall of the body in the preliminary drawing.

FIG. 12 is a graph showing the relationship between the lifter pad force and the average thickness of the circumferential wall of the body in the second compression drawing. In FIG. 12, the vertical axis represents an average thickness of the circumferential wall of the body after the second compression drawing, and the horizontal axis represents the lifter pad force (kN) during the second compression drawing. As with the first compression drawing, it can be seen that the average thickness of the circumferential wall of the body increases linearly as the lifter pad force during the second compression drawing increases. However, for the body element having a lifter pad force of 50 kN during the first compression drawing, the thickness was increased to almost the same thickness as the mold clearance at a lifter pad force of about 30 kN during the second compression drawing, and even if the lifter pad force was further increased; the thickness showed a constant value. These results mean that it is possible to increase the thickness of the body element to the substantially same thickness as the mold clearance by adjusting (increasing) the lifter pad force. In the second compression drawing process, it can be seen that a lifter pad force of about 10 kN or more can increase the thickness as compared with the average thickness of the circumferential wall of the body in the first compression drawing.

FIG. 13 is a graph (Comparative Example) showing the relationship between the circumferential wall thickness before finish ironing and the product inner diameter at each measurement position in the molded member subjected to the finishing ironing using the straight type mold shown in FIG. 10 (*a*), and FIG. 14 is a graph (Inventive Example) showing the relationship between the circumferential wall thickness before finish ironing and the product inner diameter at each measurement position in the molded member subjected to the finishing ironing using the clearance changing type mold shown in FIG. 10 (*b*), and FIG. 15 is an explanatory view showing the inner diameter dimension measurement positions in FIGS. 13 and 14.

As shown in FIG. 15, for each of the molded member using the straight type mold and the molded member using the clearance changing type mold, the measurement of the inner diameter was conducted at three positions: a position of 5 mm, a position of 30 mm and a position of 55 mm, from the top portion of the top wall 100 in the depth direction of the body 10. As shown in FIG. 7, the sheet thickness is locally thinner near the product shoulder (H=5). Therefore, when the straight type mold is used, as shown in FIG. 13, insufficient ironing is generated at the position of H=5 mm to increase the inner diameter, so that a tendency to deviate from the upper limit of the inner diameter standard is observed.

On the other hand, for the clearance changing type mold, the inner diameter (mold clearance) of the die 51 near the locally thinned shoulder is small, and it is understood, as shown in FIG. 14, that the inner diameter at H=5 mm position is reduced and improved to almost the same level as H=30 mm at the center portion of the body circumferential wall. Further, it can be seen that as the lifter pad force of the compression drawing is stronger (as the circumferential wall thickness before ironing is thicker), the accuracy of the inner diameter dimension in the height direction is improved, and the effect of the present invention is remarkably produced. This would be because as the lifter pad force is stronger, the circumferential wall thickness before ironing will be thicker, so that the material will be easily pressed against the punch, and the divided die optimizes the mold clearance value according to the circumferential wall thickness, so that the product inner diameter approaches the punch diameter that is the standard.

A method for setting the mold clearance (the inner diameter dimension of the die for ironing the vicinity of the shoulder) of the upper portion of the body element by the clearance changing type mold will be now described. The setting of the mold clearance is carried out by measuring an upper inner diameter (an inner diameter at the position of H=5 mm) of the molded member 1 prepared by using the straight type mold (see FIG. 10 (*a*)) and determining a proper value from the relationship among the measured upper inner diameter, the standard upper limit and the standard lower limit of the inner diameter, and the punch diameter.

In the following descriptions, the production of the molded member 1 using the straight type mold is referred to as a preliminary experiment (see FIG. 10 (*a*)), the mold clearance of the preliminary experiment is referred to as a standard value, the difference between the product inner diameter and the standard upper limit is referred to as an upper limit deviation amount, the difference between the product inner diameter and the standard lower limit value is referred to as a lower limit deviation amount, the diameter of the punch 50 (see FIG. 10) of the finishing ironing mold is referred to as a punch diameter, and the difference between the product inner diameter and the punch diameter is referred to as a punch diameter deviation amount. FIG. 16 is an explanatory view showing an example of the relationship between the product inner diameter and the standard dimension or the like of the molded member 1 produced by the preliminary experiment.

FIG. 17 is a graph showing a change of the upper inner diameter of the molded member 1 when changing the mold clearance at the upper portion of the body element in the clearance changing type mold. Each of Examples 1 to 5 in FIG. 17 shows the measured upper portion inner diameter of the molded member 1 when the mold clearance of the upper portion of the body element in the clearance changing type mold was set as follows:

Example 1: standard value−(upper limit deviation amount/2);

Example 2: standard value−(upper limit deviation amount+punch diameter deviation amount)/4;

Example 3: standard value−(punch diameter deviation amount/2);

Example 4: standard value−(punch diameter deviation amount+lower limit deviation amount)/4; and Example 5: standard value−(lower limit deviation amount/2).

The size of the mold clearance of the upper portion of the body element in Example 1 shown in FIG. 17 is set such that the product inner diameter is equal to the standard upper limit. In practice, however, the inner diameter of the product after removal of the molded member after the finishing ironing from a finishing mold was increased due to spring-back, which exceeded the standard upper limit. On the other hand, the size of the mold clearance of the upper portion of the body element in Example 5 is set such that the product inner diameter is equal to the standard lower limit. However, the product inner diameter after removal of the mold member after the finishing ironing from a finishing ironing mold was increased due to the spring-go, which exceeded the standard lower limit.

Further, the size of the mold clearance of the upper portion of the body element in Example 3 is set such that the product inner diameter is equal to the punch diameter. However, the product inner diameter after removal of the molded member after the finishing ironing from a finishing mold was increased due to the spring-go and finished to an inner diameter smaller than the punch diameter of 36.16 mm. It was finished to have the inner diameter smaller than the punch diameter, which was within the dimensional standard.

As shown in FIG. 17, in each of Examples 2 to 4, the product upper portion inner diameter of the molded member 1 was within the dimensional standard. Therefore, it was found that it was preferable to measure the inner diameter of the product produced in the preliminary experiment (the mold clearance at this time is a standard value), and to set the mold clearance of the upper portion of the body element in the clearance changing type mold to be within ranges of a value or less of the standard value−(upper limit deviation amount+punch diameter deviation amount)/4 and a value or more of the standard value−(punch diameter deviation amount+lower limit deviation amount)/4. In other words, the mold clearance of the upper portion of the body element in each of Examples 2 and 4 can be set such that the inner diameter of the product after removal from the finishing ironing mold is equal to the standard upper limit or the standard lower limit by setting the clearance to a small clearance in anticipation of the amount of the product inner diameter deviating from the target inner diameter due to spring-back or spring-go.

In the preliminary experiment, it is premised that the upper inner diameter at the position of H=5 mm exceeds the respective standard values (the standard upper limit, the punch diameter, and the standard lower limit). Even if the measurement result of the upper inner diameter is lower than or equal to any of the standard values, a minus value or zero may be used as a deviation amount of each of the above relational expressions.

Here, a method for calculating each deviation amount will be described using specific examples. As shown in FIG. 16, each standard value is as follows:

Standard upper limit: 36.35 mm;

Punch diameter: 36.16 mm; and

Standard lower limit: 36.05 mm.

If the upper inner diameter of the molded member 1 produced by using the straight type mold (FIG. 10 (*a*)) is 36.45 mm, i.e., if the upper inner diameter is larger than the respective standard values, each deviation amount is as follows:

Upper limit deviation amount: 36.45-36.35 (standard upper limit value)=0.10 mm;

Punch diameter deviation amount: 36.45-36.16 (punch diameter)=0.29 mm; and

Lower limit deviation amount: 36.45-36.05 (standard lower limit value)=0.40 mm.

Therefore, if the upper inner diameter exceeds the respective standard values (the standard upper limit, the punch diameter, and the standard lower limit), a plus value is used as each deviation amount of the above relational expressions when setting the mold clearance of the upper portion of the body element in the clearance changing type mold.

On the other hand, when the upper inner diameter is 36.16 mm, i.e., when the upper inner diameter is lower than the standard upper limit and equal to the punch diameter, each deviation amount is as follows:

Upper limit deviation amount: 36.16-36.35 (standard upper limit)=−0.29 mm;

Punch diameter deviation amount: 36.16-36.16 (punch diameter)=0 mm; and

Lower limit deviation amount: 36.16-36.05 (standard lower limit)=0.11 mm.

Therefore, if the upper inner diameter is lower than the upper limit and equal to the punch diameter, a minus value and zero are used as the upper limit deviation amount and the punching diameter deviation amount when setting the mold clearance of the upper portion of the body element in the clearance changing type mold.

According to such a method for manufacturing the molded member, at least one finishing ironing process is carried out such that the mold clearance of the upper portion of the body element 20*a* is narrower than the mold clearance of the lower portion of the body element 20*a*, so that even if the upper portion of the body element 20*a* is not sufficiently thickened by the compression drawing, an insufficient amount of ironing in the upper portion of the body element 20*a* can be avoided. This can result in improved inner diameter accuracy over the entire body 10 of the molded member 1. This configuration is particularly useful in applications for which highly inner diameter accuracy of a molded member such as a motor case is required.

Further, the at least one finishing ironing process is carried out such that the mold clearance of the upper portion of the body element 20*a* is narrower than the mold clearance of the upper portion of the body element 20*a* using a die including at least two divided dies 51*a*, 51*b* having different inner diameters, along the drawing direction of the body element 20*a*, so that the mold clearance can be easily changed and adjusted, and good inner diameter accuracy can be more reliably obtained.

Furthermore, based on measurement of an inner diameter of a product produced in a preliminary experiment (a mold clearance at this time is a standard value), the mold clearance of the upper portion of the body element is set within a range of a value or less of the standard value−(upper limit deviation amount+punch diameter deviation amount)/4 and a value or more of the standard value−(punch diameter deviation amount+lower limit deviation amount)/4, so that good inner diameter accuracy can be more reliably obtained.

Moreover, the compressive force 42*a* in the plurality of compression drawing processes can be adjusted, so that even if there are variations in conditions such as a sheet thickness of the base metal plate, the sheet thickness of the circumferential wall of the body element 20*a* after the compression drawing can reliably approach a target value, and good inner diameter accuracy can be more reliably obtained.

Although the embodiment has been described in such a manner that the die 51 is divided into two divided dies 51*a*, 51*b*, the die 51 may be divided into three or more divided dies. If the mold clearance of the upper portion of the body element 20*a* is narrower than the mold clearance of the lower portion of the body element 20*a*, for example, a non-divided die may be used such as a die in which the first divided die 51*a* and the second divided die 51*b* are integrated or the like. A portion where the mold clearance is changed may be formed by an inclined surface, rather than by a step.

Further, the present embodiment has been described in such a manner that the three compression processes are performed. However, the number of the compression processes may be optionally changed, according to the size and required dimensional accuracy of the molded member 1.

What is claimed is:

1. A method for manufacturing a molded member by carrying out a multi-stage drawing process and a finishing ironing process on a base metal sheet, the molded member comprising: a tubular body; and a flange formed at an end portion of the body, wherein the multi-stage drawing process comprises: a preliminary drawing process for forming a preliminary body having a body element from the base metal sheet; and a plurality of compression drawing processes performed after the preliminary drawing process, the compression drawing processes drawing the body element while applying compressive force along a depth direction of the body element to a circumferential wall of the body element; and wherein the finishing ironing process is carried out such that a mold clearance of an upper portion of the body element is narrower than a mold clearance of a lower portion of the body element, wherein, based on measurement of an inner diameter of a product produced in a preliminary experiment using a general finishing ironing die including a punch and a die, wherein an inner wall of the die extends in parallel to a depth direction of a body element and a clearance between the punch and the die is constant over an entire region in the depth direction of the body element, the mold clearance of the upper portion of the body element is set within a range of a value V1 or less and a value V2 or more, where $$V1=SV-(UA+PA)/4, \text{ and}$$

$$V2=SV-(PA+LA)/4,$$

where

SV is a standard value being the clearance between the punch and the die used in the preliminary experiment, UA is an upper limit deviation amount being a difference between an inner diameter of the product and a standard upper limit of the inner diameter, LA is a lower limit deviation amount being a difference between the inner diameter of the product and a standard lower limit of the inner diameter, and PA is a punch diameter deviation amount being a difference between the inner diameter of the product and a punch diameter of the punch.

2. The method for manufacturing the molded member according to claim 1, wherein the finishing ironing process is carried out such that the mold clearance of the upper portion of the body element is narrower than the mold clearance of the lower portion of the body element using a die comprising at least two divided dies having different inner diameters, along a drawing direction of the body element.

3. The method for manufacturing the molded member according to claim 1, wherein the compressive force in the plurality of compression drawing processes can be adjusted.

4. The method for manufacturing the molded member according to claim 1, wherein the multi-stage drawing process is performed using a mold comprising a die having a hole, a punch configured to push into the hole, and a lifter pad disposed radially outward of the punch and facing the die, the lifter pad urged against the body element to apply the compressive force along the depth direction of the body element to the circumferential wall of the body element.

* * * * *